US010829707B2

(12) United States Patent
Yates et al.

(10) Patent No.: US 10,829,707 B2
(45) **Date of Patent: *Nov. 10, 2020**

(54) METHODS FOR REDUCTION OF POLLUTANTS FROM CARBONACEOUS MATERIALS PRIOR TO COMBUSTION

(75) Inventors: James P. Yates, Charleston, IL (US); Richard L. Sumner, Vincennes, IN (US); John C. Crelling, Carbondale, IL (US)

(73) Assignee: Micronizing Technologies, LLC, Allen, TX (US)

( * ) Notice: Subject to any disclaimer, the term of this patent is extended or adjusted under 35 U.S.C. 154(b) by 584 days.

This patent is subject to a terminal disclaimer.

(21) Appl. No.: 11/918,175

(22) PCT Filed: Apr. 10, 2006

(86) PCT No.: PCT/US2006/013695

§ 371 (c)(1),
(2), (4) Date: Oct. 9, 2007

(87) PCT Pub. No.: WO2006/110837

PCT Pub. Date: Oct. 19, 2006

(65) Prior Publication Data

US 2009/0050537 A1 Feb. 26, 2009

Related U.S. Application Data

(60) Provisional application No. 60/670,576, filed on Apr. 11, 2005.

(51) Int. Cl.
*C10G 1/00* (2006.01)
*C10L 9/00* (2006.01)

(52) U.S. Cl.
CPC ..... *C10L 9/00* (2013.01)

(58) Field of Classification Search
CPC ..... C10G 1/00; C10G 1/008; C10G 15/00; C10G 15/08; C10G 15/10; C10G 15/12; B02C 19/00; B02C 19/18
USPC ..... 208/426
See application file for complete search history.

(56) References Cited

U.S. PATENT DOCUMENTS

| | | | | |
|---|---|---|---|---|
| 2,752,097 | A * | 6/1956 | Lecher | B01J 19/10 241/17 |
| 4,120,783 | A * | 10/1978 | Baummer | B03B 5/02 209/18 |
| 4,176,042 | A * | 11/1979 | Fahlstrom | 208/426 |
| 4,537,599 | A * | 8/1985 | Greenwald, Sr. | 241/1 |
| 5,667,149 | A * | 9/1997 | Eisinger | B02C 15/001 241/119 |
| 6,227,473 | B1 * | 5/2001 | Arnold | B02C 13/18 241/1 |
| 6,405,948 | B1 * | 6/2002 | Hahn et al. | 241/1 |
| 2002/0117564 | A1 * | 8/2002 | Hahn | B02C 13/18 241/1 |
| 2005/0145732 | A1 * | 7/2005 | Oder et al. | 241/119 |

OTHER PUBLICATIONS

Lucero, Andrew. Coal Cleaning Using Resonance Disintegration for Mercury and Sulfur Reduction Prior to Combustion, Apr. 1, 2005, Accessed from DOE Scientific and Technical Information Bridge <http://www.osti.gov/bridge/product.biblio.jsp?query_id=4&page=0&osti_id=910130>.*

* cited by examiner

*Primary Examiner* — Michelle Stein
(74) *Attorney, Agent, or Firm* — Shannon W. Bates; Harper Bates & Champion LLP

(57) ABSTRACT

Methods for reducing potential pollutants in carbonaceous materials such as coal, lignites and the like prior to utilization such as by combustion, the invention in preferred embodiments processes such materials by resonance disintegration including inter alia subjection to rapid pressure increases and decreases to reduce the materials to particle sizes of a preferable mean value of approximately fifty microns or less. Pollutants such as sulfur, mercury and other heavy metals bound in a mineral fraction and micronized by such processing can then removed by classification techniques based on physical differences between a micronized carbonaceous fraction and the mineral fraction. Combustion of the micronized carbonaceous fraction substantially free of the mineral fraction results in emissions having reduced levels of sulfur, mercury and other toxic substances. The methods of the invention further include removal of water from carbonaceous materials such as coal, lignites and the like by subjection of such materials to resonance disintegration.

15 Claims, No Drawings

METHODS FOR REDUCTION OF POLLUTANTS FROM CARBONACEOUS MATERIALS PRIOR TO COMBUSTION

CROSS-REFERENCE TO RELATED APPLICATIONS

This application is the National Stage Application of International Application No. PCT/US06/13695 filed on Apr. 10, 2006, which claims the benefit of U.S. Provisional Patent Application Ser. No. 60/670,576 filed Apr. 11, 2005, both of which are incorporated herein by referenced in their entireties.

TECHNICAL FIELD

The invention relates generally to processes for the reduction of pollutants from carbonaceous materials such as coal, lignites and the like and particularly to processes known as "coal cleaning" processes. The invention further relates to water removal from such carbonaceous materials as well as to processes for increasing the heating value of such materials.

BACKGROUND ART

Coal and similar carbonaceous materials have long been known in the art as "mixtures of impurities". Aside from the humor inherent in this understanding of the nature of these valuable resources, raw carbonaceous materials known as coal and the like as mined and as are often presented for combustion in the generation of useable energy such as electrical power and the like unfortunately contain inorganic constituents having little or no heating value in addition to organic constituents. The inorganic constituents add no energy content to the coal but do constitute "impurities" which when burned with the organic constituents produce environmental pollutants that limit the utility of coal and the like even with extensive and expensive post-combustion efforts to remove these pollutants. The inorganic constituents are typically incorporated into a coal through natural processes and are generally referred to in the art as "mineral matter" whether occurring in mineral or non-mineral forms. Residues of this mineral matter as well as of the organic constituents of coal are generally referred to as "ash", prior coal cleaning processes intending the reduction of ash in part to increase the heating value pre-combustion of the coal. Prior coal cleaning processes have proven at least partially effective in removal of mineral matter such as pyrites, sulfides and the like with a corresponding reduction in ash and post-combustion pollutants as well as increases in the heating value of the cleaned coal. Such prior processes typically involve the crushing or grinding of raw coal followed by physical separation processes which utilize density differences between resulting carbonaceous and mineral particles. These prior processes are costly due to the energy required to pulverize the raw coal, the pulverization apparatus also requiring frequent repair and parts replacement due to the high impact nature of such processing. Mineral matter associated with coal as major elements, such as iron, aluminum, silicon and alkali and alkaline earth metals such as calcium, sodium and potassium contribute to ash formation. Trace elements such as mercury, arsenic, cadmium and other heavy metals have potentially adverse environmental and human health effects. Governmental regulations now limit the quantities of mercury, in particular, which can be present in power plant emissions and the like.

Regulation of other heavy metals will likely become more stringent as the health affects of these pollutants become recognized and the industry develops abilities to address these health and environmental concerns. Amendments to the Clean Air Act in 1990 names 189 substances as hazardous air pollutants including eleven non-radiogenic elements commonly found in coal in trace levels including antimony, arsenic, beryllium, cadmium, chromium, cobalt, lead, mercury, manganese, nickel and selenium. Radionuclides as a class are considered to be pollutants and include uranium and thorium. During combustion of coal and similar organic carbonaceous materials, at least some quantities of at least certain of these trace elements are released into the atmosphere in volatile forms or become entrained with fine particulates that escape into the atmosphere. Many or most of these pollutant-forming substances are bound into mineral matter such as pyrites and sulfides although such substances are also otherwise present in raw coal. Removal of at least substantial portions of the pollutant-forming substances bound into pyrites, sulfides and the like with cost efficiencies relative to prior art processes constitutes a major advance in the art. The present methodology results in enhanced liberation of discrete solid phases, including enhanced liberation of organic and mineral phases that occur in coals and similar organic carbonaceous materials with reduction of ash, sulfur and trace element levels, thereby providing cost effective processes for treatment of coals such as pre-combustion treatment and particularly treatment of low grade coals to increase heating values of such coals while reducing the levels of pollutants formed on combustion of such coals.

Carbonaceous materials such as lignites and coals can be improved pre-combustion by water reduction, water removal increasing the heating value of the resulting material. Prior water reduction processes, however, are expensive due in part to the energy required to heat such materials to drive out moisture.

DISCLOSURE OF THE INVENTION

The disclosures of U.S. Pat. Nos. 6,135,370; 6,227,473; 6,405,948 and 6,726,133 are incorporated hereinto by reference.

The invention herein disclosed encompasses methodology for liberating mineral matter encased, included and/or associated with useful organic carbonaceous matrices such as coal and the like, the liberated mineral matter typically taking the form of pyrites, sulfides and the like and having physical characteristics such as specific gravities sufficiently different from the specific gravities of organic fractions of the carbonaceous matrices to permit separation therefrom such as by various separating processes. Separation can be accomplished via air classification processes, magnetic or electrostatic processes as well as electronic processes inter alia. The mineral matter liberated according to the invention includes substances causative of ash formation post-combustion of the coal or other organic carbonaceous material, such as iron and the like, and trace elements causative of pollutant formation post-combustion such as mercury, arsenic, cadmium, various heavy metals and radionuclides. Sulfur compounds contained in such mineral matter are also liberated according to the invention, particles of the mineral matter capable of liberation from organic carbonaceous matrices according to the invention being separable from particles of the carbonaceous matrix so that the combustible matrix can then be used as an energy source and the like and having an increased heat value with reduced pollutant emission. Processing according to the invention of carbonaceous matrices such as coals and the like also proves useful when the coals are subjected to processes such as gasification and the like.

The raw coal or other carbonaceous material is processed according to preferred embodiments of the invention to reduce said coal to preferred mean particle sizes on the order of 50 microns, organic and inorganic constituents of the coal being dissociated into discrete organic and inorganic phases with minimal shearing of the pollutant-forming substances such as mercury onto particles of the coal. In conventional impact processing of coal for pulverization to reduced particle size prior to cleaning and subsequent combustion or other utilization, the pollutant-forming substances can be smeared onto surfaces of the coal due to the nature of such impact processing. The non-impact or relatively low-impact processing disclosed herein results in substantial reduction of smearing and/or association of mineral substances primarily from discrete mineral phases, thereby increasing the proportion of the mineral substances including harmful trace elements removable from the coal prior to utilization.

The processes of the invention essentially "clean" coal and similar organic carbonaceous matrices having impurities encased, included or otherwise associated therewith, coals being primary examples of such carbonaceous matrices, to maximize reduction of ash-forming minerals, sulfur and environmentally undesirable trace elements with minimum loss of energy content. The processes of the invention include a step of subjecting the raw or essentially raw coal to resonance disintegration such as can include rapid pressure increases and decreases, such as by resonance disintegration processing as disclosed in U.S. Pat. No. 6,135,370 inter alia, to cause constituents of the material being processed to resonate at different frequencies according to different elasticities with the result of relatively clean liberation of organic carbonaceous constituents from inorganic mineral constituents in particulate forms whereby crossover of portions of the organic and inorganic constituents is minimized, thereby reducing the incidence of mineral matter in a carbonaceous phase after subsequent separation as well as reducing the incidence of organics in a separated mineral phase. Reduced carry-over of organics into the separated mineral phase or phases increases the useable content of the separated organic phase for subsequent utilization as an energy source or for other use. In particular, processing according to the invention permits removal of sufficient mercury to allow cost-effective compliance with presently mandated mercury emissions standards through enhanced removal of pyrites and the like from coals prior to combustion in power generation plants.

Processing of carbonaceous materials including coals, lignites and the like is improved by reduction of water content thereby improving heating value of the resulting material. Processing according to the invention therefore improves heating value of such materials by concurrent water reduction while inorganics are prepared for subsequent removal processing.

Processing of coals and similar carbonaceous materials according to the present invention subjects the coals to destructive resonance, shock waves and vortex-generated shearing forces inter alia to reduce the coals to particle sizes of a preferred mean value of approximately 50 microns and less without smearing together of carbonaceous and mineral constituents of the raw materials. Processing to particle sizes greater and less than 50 microns is contemplated according to the invention. The non-impact or relatively low-impact processing of the invention requires substantially less energy than is necessary for conventional impact/grinding processes. More uniform particle sizes and dimensions are produced according to the invention than is possible with conventional methodology, thereby permitting more predictable combustion characteristics of the resulting particulate organic fraction from which the particulate inorganic fractions comprised inter alia of pyrites, sulfides and the like are separated prior to utilization as a fuel or otherwise. Post-combustion emissions of mercury, sulfur and other potentially hazardous and/or toxic compounds are thereby substantially reduced whether with or without post-combustion emission controls. The inorganic fractions removed from coals according to the invention can be disposed of as wastes or can be utilized as sources of valuable by-products.

In preferred embodiments of the invention, raw coals or similar carbonaceous materials such as lignites and subbituminous materials having inorganic mineral matter incorporated thereinto are fed into an input of a resonance disintegration mill such as is disclosed in the United States patents incorporated hereinto by reference, the raw coal being immediately entrained in a flow created by rotation of a plurality of rotors carried by a rotating shaft and moving at rotational speeds on the order of 2500 to 5000 rpm as examples, greater rotational speeds being also useful. The alternating increasing and decreasing pressures to which the coal is subjected during such processing causes the coal to flow in an alternating outward and inward flow around peripheral edges of the rotors and through orifices formed in plates positioned between adjacently located pairs of the plurality of rotors, each orifice plate extending inwardly from interior walls of a housing containing the rotors and orifice plates to a central aperture that provides an orifice about the rotating shaft to which the rotors are mounted. Pressures acting on the coal alternately increases and decreases as flow passes through each orifice and expands in that space below each orifice plate. Compression and decompression occurs in the flow as vanes on the rotors pass by static structure contained in the housing. The compressions and decompressions may differ in magnitude and duration. The flow of materials within the mill is substantially free of high angle impacts of the coal on structural portions of the mill, thereby preventing wear of the mill and obviating smearing together of organic and inorganic constituents as is caused by impact processing such as occurs in pulverization apparatus including ball mills and jet mills.

Rotors employed in suitable non-impact or low-impact mills can be angularly offset from each other so that the compression and decompressions are non-synchronous. Establishment of a series of compressions and decompressions can occur at differing frequencies depending on the number of rotors, the number of apices on the rotor and the number of static interdigitating elements disposed within the housing as well as other structural characteristics of the mill. Pressure change frequencies can be tuned to resonate to characteristics of a particular coal to more effectively process particular coals.

Accordingly, it is an object of the invention to provide methods for processing organic carbonaceous materials such as coals to remove inorganic constituents prior to utilization of the organic constituents of the carbonaceous materials, thereby to increase the heat value thereof and decrease pollutants when the organic constituents subsequently separated from the inorganic constituents are utilized as combustible fuels.

It is another object of the invention to provide methods for low-energy pre-utilization processing of coals and the like to reduce particle sizes of organic and inorganic constituents of the coals to preferred mean sizes of approximately 50 microns and less without smearing of the constituents together with a resulting inability to efficiently separate the respective constituents without carryover of portions of either of the constituents carried on the other constituent.

It is a further object of the invention to provide methods for reducing air pollution resulting from the combustion of coals and the like by processing of the coals pre-utilization by resonance disintegration to liberate inorganic constituents from organic constituents with subsequent separation of the respective constituents prior to utilization as a fuel.

A still further object of the invention is to provide methods for increasing heating value of carbonaceous materials such as coals, lignites and the like by reducing water content whether or not associated with subsequent removal of inorganics prepared for removal by classification methodology.

Further objects and advantages of the invention will become more readily apparent in light of the following detailed description of the preferred embodiments.

BEST MODE FOR CARRYING OUT THE INVENTION

Preferred embodiments of the invention process coals and similar carbonaceous materials such as lignites having inorganic constituents associated therewith in the form of mineral matter whether or not in trace amounts for liberation of at least certain forms thereof followed by separation of the liberated inorganic constituents from organic constituents, thereby to increase the heat value of a resulting organic fraction as well as reduction of levels of environmentally hazardous substances such as sulfur, mercury and heavy metals in effluent gases resulting from combustion of the organic fraction as a fuel. Undesirable substances in coals and the like including trace elements can take the form of dissolved salts and other inorganic substances present in pore water of the coal, inorganic elements incorporated within organic constituents of coal macerals and discrete inorganic particles, both crystalline and non-crystalline, in the form of mineral constituents. Any trace element may occur in more than one form in a single coal and modes of occurrence vary between coals. A particular coal or similar carbonaceous material can therefore differ in the form in which such trace elements and mineral matter exists relative to another coal.

Dissolved salts and the like can be removed from most coals except low rank coals by water washing or can be neglected as insignificant. Trace element association with organic and/or mineral constituents produce environmental consequences. While trace elements chemically associated with organic constituents of a coal are resistant to removal, those inorganics associated with discrete inorganic particles whether encased, included or otherwise incorporated into the organic constituents are susceptible to removal or reduction by practice of the present invention, particular coal mineralologies being of interest in understanding of such processes. Gross coal mineralogy is of four basic mineral types, that is, quartz, clays, sulfides including pyrites and carbonates. Minerals in coals can derive from mineral-rich parting or associated roof and floor rocks and from extraneous elasticts incorporated during deposition and lithification. Minerals can occur as isolated crystals and in the organic matrix of coal in differing textural forms. Pyrite, in particular, can occur as single crystals, void fillings, irregular and dendritic masses and clusters known as framboids, the more significant forms being specific to individual coals with the more massive ones being more easily removable from the coal. Removal of trace elements according to the invention is most effective when the trace elements are present in pyrite and other sulfides in forms encased or included within the organic matrix of the coal. Processing according to the invention shears the material at physicochemical boundaries between the mineral constituents and the organic constituents of the coal. Subjection of raw coal or fines containing mineral matter resulting from other processing or handling to resonance disintegration processing also causes cleavage along natural planes both within the organic and the inorganic constituents of the materials, thereby resulting in the formation of particulates of both the organic and inorganic constituents, particle sizes having a preferred mean of approximately 50 microns and less, although smaller or larger mean values can be obtained. Separation processing such as conventional air classification, magnetic separation, electrostatic separation and the like such as are based on physical differences between the organic and inorganic particles is readily accomplished. The resulting particulate organic fraction is substantially free of trace elements that can be present in pyrites and the like, such as mercury smeared onto surfaces of the organic particulates, major portions of the trace elements and substances such as sulfur originally in the form of discrete inorganic material being removed from the organic fraction which can then be utilized as a fuel capable of combustion with substantially reduced levels of environmentally harmful trace elements and the like in combustion emissions.

In preferred embodiments of the invention, carbonaceous materials and particularly organic carbonaceous materials such as coals, lignites and other lithified or non-lithified materials are processed by resonance disintegration such as is disclosed in the patents incorporated hereinto by reference. However, resonance processing or resonance disintegration processing according to the invention contemplates subjection of the materials to resonance at a selected frequency or frequencies in suitable apparatus to cause cleavage along natural cleavage planes and physiochemical boundaries within the materials. Subjection to resonance regardless of the manner by which resonance is generated causes reduction in particle sizes of the materials, portions of the particles such as organic constituents thereof cleaving at a different rate than may occur within inorganic constituents thereof. Such differential cleavage can occur due to the frequency or frequencies generated. Resonance can be created according to the invention by pulses generated by increasing and decreasing pressure charges acting on the materials. In high velocity streams of the materials, shearing forces and g-forces act to reduce particle size, all such size reduction mechanisms occurring substantially without impact between the particles and without impact between the particles and surfaces of apparatus employed to generate resonance acting on the particles or to generate other effects on the particles. Inducers, transducers and resonance disintegration mills such as are disclosed in the patents incorporated hereinto by reference induce resonance in the materials to reduce particle sizes without impacts on the particles. Non-canceling harmonics can be utilized to facilitate resonance processing and speeds within entrained flows can be varied according to the definition of processing according to the invention. Resonance processing in vertically-oriented or horizontally-oriented mills can be effected according to the invention. Standing waves can be generated within such mills to facilitate non-impact reduction of particle sizes.

Processing according to particularly preferred embodiments of the invention entrains material fed into a resonance disintegration mill in a strong flow, the material being comminuted making minimal contact with interior portions of the mill housing or with other structure contained within the housing due to creation of a Coanda effect closely following contours of rotor peripheries and orifice plate rims. This Coanda flow rapidly changes direction when rounding peripheral edges of the rotors and rims of the orifices and alternates between a flow radially directed outwardly and a flow directed radially inwardly. Orifice sizes can be increased successively to maintain a negative back pressure to aid in maintaining the Coanda flow by maintaining high velocity of the entraining fluid and of the particles. A resonance disintegration mill can disintegrate large particles or lumps of material into micron-sized particles with little or no wear on the mill. Shock waves generated each time the material being processed experiences rapid acceleration along with additional shock waves generated as rotor vanes pass corners of the housing cause rapid size reduction within the mill. The organic and inorganic constituents of the coal characteristically exhibit different elasticities and resonate at differing frequencies on application of shock waves as aforesaid to provide a relatively clean non-impact liberation of the inorganic constituents from the organic matrix of the coal. Impacts between particles are minimized according to the teachings of the invention.

Samples of Wyoming Wyodak, Illinois #5 and Pittsburgh #8 coals processed by resonance clean disintegration as aforesaid with liberation of pyritic minerals, the liberated minerals being removed by cyclone classification as well as other known processes with a resulting relatively clean coal having reduced water content and thus increased heat value in terms of related BTU values due to removal of pore and other associated water due to heat generated during resonance disintegration processing inter alia as well as removal of major portions of the inorganic constituents of the coals. Processing of the lignites in particular is useful to remove water. Processing following resonance disintegration can occur in a Baum jig, a dense-medium washer, a dense-medium cyclone, a hydrocyclone or by froth flotation or oil agglomeration. Gravity separation can occur through use of conventional apparatus. Separation processes following resonance disintegration can also include magnetic electrostatic and electronic processing.

The Wyoming Wyodak, Illinois #5 and Pittsburgh #8 coals processed according to the invention were sized to solids of one to three inch diameter, processing in the resonance disintegration mill occurring at 4250 to 4350 rpm. The Wyodak coal was reduced to a d50 of 278 microns after one pass through the mill and was processed a second time to yield a d50 of 145 microns. The second pass was taken in order to liberate pyrites and the like that would possibly not be exposed in the particles of larger size. The softer nature of Wyodak coal may cause the d50 of the coal to be greater than that of the Illinois and Pittsburgh coals. Two passes of the Illinois coal yielded respective d50's of 45 microns and 33 microns, microscopic examination of the runs indicating that a single pass liberated pyrites and the like as efficiently as two passes. A single run of the Pittsburgh coal resulted in a d50 of 77 microns.

The moisture content of the coals so processed was reduced without the application of extraneous heat. Moisture reduction of greater than 2% of initial weight occurred for the Wyodak and Illinois coals, the reduction of the Illinois coal being approximately 50% of initial moisture. Processing of lignites according to the invention reduces water content and increases the heat value of the resulting processed material. Such processing can occur either with or without subsequent removal of inorganics prior to further utilization of the resulting material.

The processed coals were sent to the Maceral Separation Laboratory of Southern Illinois University (SIU) for examination. SIU noted that pyrite was present in the subject coals as small single crystals, framboids, and massive vein and cell fillings, and that based on petrographic analysis all of these types of pyrite are being liberated. SIU also estimated that approximately 90-95% of the pyrite was liberated from the carbonaceous fraction in all three coals. Samples of the raw, unprocessed coals and the resonance disintegration processed coals were analyzed before and after for proximate/ultimate sulfur forms, total mercury and elemental mercury. Approximately half of the processed material was then run through a commercial separation process to remove the liberated pyrite from the organic material. A sample of the Illinois #5 coal was also separated in a Density Gradient Centrifuge (DGC) for comparison. The commercially separated coal and mineral phases were sent for analysis and tests in the Combustion Test Facility of Western Research Institute, Laramie, Wyo. to determine handling, feeding, combustion and emissions characteristics. The cleaning process of the invention recovered a high percentage of original BTU value for all three coals. For the Wyodak sample, 95% of the BTU value was retained in the cleaned fraction, 90% of the BTU value was retained in the Pittsburgh coal and 98.5% of the BTU value was retained in the Illinois #5 coal. Liberation and separation was effective for the Wyodak coal, with approximately 82% of the pyritic sulfur removed. Processing of the Illinois #5 and the Pittsburgh #8 coals removed approximately 26% and 20% of the pyritic sulfur respectively. The pyritic sulfur for the Illinois coal decreased 64% (compared to 26%) when the separation was performed by DGC, indicating that the separation process limited removal of pyritic material.

Mercury was removed from the coals by removal of pyrite from the coals. Total mercury of each coal was measured in raw samples and then in cleaned samples. Approximately 30% of the mercury was removed with the pyrite in the Wyodak coal, with 14% of the mercury being removed from the Pittsburgh coal.

Carbonaceous materials and particularly organic carbonaceous materials such as coals, other lithified materials, bituminous materials, sub-bituminous materials, lignites and the like can be processed after subjection to resonance processing according to the invention via processes other than combustion, such processes including the various forms of gasification. Gasification is improved by prior use of the present processes due to the ability of such present processes to reduce particle sizes to virtually any desired size range with energy efficiency, thereby increasing surface areas of the materials as accrues from increasingly smaller particle sizes. The materials so processed thus take the form of particles of reduced sizes that are more reactive and thus more available for further processing such as combustion, gasification or the like, the materials being reduced to desirable particle sizes with favorable energy expenditure and with minimal wear on surfaces of size reduction apparatus. Gasification of the resonance-treated particles formed according to the invention can occur either prior to or subsequent to separation of at least some of the inorganic constituents of the materials such as cause pollutant generation on combustion of said materials. Removal of significant proportions of the polluting inorganic constituents is preferred prior to gasification in order to assure to the degree possible that the inorganic constituents will not be carried over into products generated by gasification.

Coals reduced to sufficiently small particle sizes can find further utility through incorporation of the organic carbonaceous particles into slurries which can be burned such as in large diesel engines and the like. The reactivity of the coals can be sufficiently increased to permit combustion in such situations with acceptable residues of carbon and the like.

Coal utilization can further be improved through reduction of limestone to particle sizes having a d90 of as low as fifteen microns, the limestone particles processed according to resonance disintegration being used for acid gas control in coal-fired boilers. Processing of limestone varies depending on the microcrystalline, macrocrystalline and other properties of the calcium carbonate comprising the limestone. Processing according to the invention can begin with limestone having sizes of approximately one inch but preferably having particle sizes of a d90 of approximately 325 mesh. Control of sulfur dioxide production in coal combustion is substantially reduced through use of limestone having a d90 of less than fifteen microns such as can economically be produced according to processing by resonance disintegration as taught herein.

Processing of carbonaceous materials and particularly organic carbonaceous materials according to non-impact or substantially non-impact processes herein taught is of particular importance in the removal of pyrites and the like from such materials. Non-impact processing according to the invention lessens the potential for chemical and physical changes in the materials and is energy efficient. Such removal of pyrites from coals and the like finds particular utility in the removal of mercury from coals including mercury bonded to or otherwise associated with surfaces of the pyrite.

Water reduction in carbonaceous materials processed according to the invention results in a processed material resistant to rehydration even when the processed material is permitted contact with ordinary humidity conditions, rehydration to values less than half of initial moisture levels occurring over periods of weeks. Water reduction according to the invention occurs essentially simultaneously with preparation of inorganics and pollutants discussed herein for subsequent removal by classification methodology whether or not such inorganics are subsequently removed. Carbonaceous materials so processed can be subjected to processing prior to resonance disintegration to pre-excite the materials such as by subjection to microwave radiation, high frequency radiation and the like to increase water reduction through rapid expansion. A single pass of lignite containing 35 to 40% initial moisture reduced moisture content to approximately 20% by only a single pass through apparatus described herein. Victorian brown coals having approximately 60% water content by mass so processed exhibit moisture reduction to approximately half of initial moisture content.

While the invention has been disclosed with reference to particular embodiments thereof, it is to be appreciated that the scope of the invention is to be limited only by the definitions provided by the appended claims.

The invention claimed is:

1. A method of liberating mineral matter from a carbonaceous matrix, comprising the steps of:

subjecting the carbonaceous matrix to substantially non-impact processing via resonance disintegration at a rotational speed ranging from 4250 rpm to 4350 rpm; and liberating mineral matter from formed particles of the carbonaceous matrix in a gas stream carrying the carbonaceous matrix and mineral matter along a flow path in a mill that effects flow of the gas, mineral matter and carbonaceous matrix around peripheral edges of a plurality of rotors in alternating inward and outward directions between an inlet and an outlet, thereby cleaving along one or more natural cleavage planes occurring between the mineral matter and the carbonaceous matrix, reducing size of the formed particles of the carbonaceous matrix, and liberating particles of mineral matter from the carbonaceous matrix, without smearing the mineral matter on the carbonaceous matrix and vice versa, wherein the carbonaceous matrix includes at least one of coal, lignites and sub-bituminous materials.

2. The method of claim 1 wherein the carbonaceous matrix comprises an organic carbonaceous matrix.

3. The method of claim 1 wherein the mineral matter comprises a sulfide.

4. The method of claim 3 wherein the mineral matter comprises pyrite.

5. The method of claim 3 wherein the sulfide contains trace elements.

6. The method of claim 5 wherein at least one of the trace elements comprise mercury.

7. The method of claim 5 wherein at least one of the trace elements is selected from the group consisting of arsenic and lead.

8. The method of claim 5 wherein the trace elements comprise heavy metals.

9. The method of claim 1 and further comprising the step of separating the liberated mineral matter from particles of the carbonaceous matrix.

10. A method for liberation of mineral matter from coal fines comprising the step of:

subjecting the coal fines to substantially non-impact processing via resonance disintegration at a rotational speed ranging from 4250 rpm to 4350 rpm in a gas stream carrying the coal fines and mineral matter along a flow path in a mill that effects flow of the gas, mineral matter and coal fines around peripheral edges of a plurality of rotors in alternating inward and outward directions between an inlet and an outlet, thereby cleaving along one or more natural cleavage planes occurring between the mineral matter and the coal fines, reducing the particle size of the coal fines, and liberating particles of mineral matter from the coal fines, without smearing the mineral matter on the coal fines and vice versa.

11. The method of claim 10 further comprising the step of separating the liberated mineral matter from particulates of the coal fines.

12. A method for removing water from organic carbonaceous matrices including coal, lignites and sub-bituminous materials while simultaneously reducing particle sizes of the matrices comprising the step of:

subjecting the matrices to substantially non-impact processing via resonance disintegration at a rotational speed ranging from 4250 rpm to 4350 rpm in a gas stream carrying the carbonaceous matrices along a flow path in a mill that effects flow of the gas and carbonaceous matrices around peripheral edges of a plurality of rotors in alternating inward and outward directions between an inlet and an outlet and thereby liberate water from the carbonaceous matrices.

13. A method for liberating mercury from carbonaceous matrices prior to combustion thereof, comprising the step of:

subjecting the carbonaceous matrices to substantially non-impact processing via resonance disintegration at a rotational speed ranging from 4250 rpm to 4350 rpm in a gas stream carrying the carbonaceous matrices along a flow path in a mill that effects flow of the gas and carbonaceous matrices around peripheral edges of a plurality of rotors in alternating inward and outward directions between an inlet and an outlet, thereby cleaving along one or more natural cleavage planes occurring between the mercury and the carbonaceous matrices, reducing the carbonaceous matrices to particles, and liberating mercury contained in the carbonaceous matrices, without smearing the mercury on the carbonaceous matrix and vice versa, wherein the carbonaceous matrices includes at least one of coal, lignites and sub-bituminous materials.

14. The method of claim 13 wherein the carbonaceous matrices comprise coal and further comprising the step of separating the liberated mercury from the coal.

15. The method of claim 13 wherein the carbonaceous matrices comprise coal and mercury liberated therefrom is bound to pyrites present therein, the pyrites also being liberated from the coal.

* * * * *